US005871303A

United States Patent [19]

Brown, III et al.

[11] Patent Number: 5,871,303

[45] Date of Patent: Feb. 16, 1999

[54] VISCOUS DRAG AND NON-LAMINAR FLOW COMPONENT OF UNDERWATER EROSION CONTROL SYSTEM

[75] Inventors: Fletcher Webster Brown, III; Laurie Ann Rathe; Rod McNeil; Patricia Ann Dellwo, all of Polson, Mont.

[73] Assignee: Marine Environmental Solutions L.L.C., Calverton, Md.

[21] Appl. No.: 672,973

[22] Filed: Jun. 17, 1996

[51] Int. Cl.[6] ..... E02B 3/04

[52] U.S. Cl. ..... 405/24; 119/221; 405/21; 405/25

[58] Field of Search ..... 405/21–25, 29–35; 119/221

[56] References Cited

U.S. PATENT DOCUMENTS

| | | | |
|---|---|---|---|
| 3,540,415 | 11/1970 | Bromley | 405/24 X |
| 3,559,407 | 2/1971 | Schuur | 405/24 |
| 3,590,585 | 7/1971 | Winter | 405/24 |
| 3,820,339 | 6/1974 | Luque | 405/24 |
| 4,221,500 | 9/1980 | Garrett | 405/24 |
| 4,337,007 | 6/1982 | Smith | 405/24 |
| 4,374,629 | 2/1983 | Garrett | 405/24 |
| 4,437,786 | 3/1984 | Morrisroe | 405/24 |
| 4,476,853 | 10/1984 | Garrett | 405/24 |
| 4,490,071 | 12/1984 | Morrisroe | 405/24 |
| 4,534,675 | 8/1985 | Morrisroe | 405/24 |
| 4,641,997 | 2/1987 | Lauer et al. | 405/24 |
| 4,657,432 | 4/1987 | Rentrop et al. | 405/25 X |
| 4,710,057 | 12/1987 | Laier | 405/30 |
| 4,722,639 | 2/1988 | Alsop | 405/25 |
| 4,738,063 | 4/1988 | Alsop | 52/163 |
| 5,007,766 | 4/1991 | Freed et al. | 405/24 |
| 5,056,956 | 10/1991 | Nicholson | 405/17 |
| 5,102,257 | 4/1992 | Creter | 405/25 |
| 5,113,792 | 5/1992 | Jones et al. | 405/25 |
| 5,141,359 | 8/1992 | Klockner | 405/26 |
| 5,158,395 | 10/1992 | Holmberg | 405/21 |
| 5,176,468 | 1/1993 | Poole | 405/23 |
| 5,176,469 | 1/1993 | Alsop | 405/24 |
| 5,257,878 | 11/1993 | Peterson | 405/15 |
| 5,259,696 | 11/1993 | Beardsley | 405/73 |
| 5,575,584 | 11/1996 | Alsop | 405/25 X |

FOREIGN PATENT DOCUMENTS

| | | | |
|---|---|---|---|
| 4543768 | 4/1971 | Australia . | |
| 1811506 | 7/1969 | Germany . | |
| 8231725 | 2/1983 | Germany . | |
| 7710671 | 9/1977 | Netherlands . | |
| 789795 | 1/1958 | United Kingdom . | |
| 1176772 | 1/1970 | United Kingdom | 405/24 |
| 1385974 | 3/1975 | United Kingdom | 405/24 |
| WO 84/04118 | 10/1984 | WIPO | 405/24 |
| WO85/03539 | 8/1985 | WIPO | 405/24 |
| 8805842 | 8/1988 | WIPO . | |
| 9010113 | 9/1990 | WIPO . | |

*Primary Examiner*—Dennis L. Taylor
*Attorney, Agent, or Firm*—Dickstein Shapiro Morin & Oshinsky LLP

[57] ABSTRACT

An underwater erosion control system (10, 110) has an array of panels of material (12, 112). Each generally rectangular panel of material has a retaining portion (20, 120) and at least one sheet (16, 116). Each sheet contains a plurality of slits, (22, 122) which are generally perpendicular to the retaining portion (20, 120). The slitted sheets disrupt laminar flow in the vicinity of the erosion control system and promote rapid precipitation of particulates out of suspension. The slits (22, 122) begin at the retaining portion and terminate at the top edge (18, 118) of the sheet. The retaining portion (20, 120) may contain openings (26, 126) sized to receive an anchor component (28) that is anchored to the sea or river bed. The panel of material (12, 112) is durable and buoyant having a polymer backing (40) laminated to a closed cell polymer foam (42).

16 Claims, 5 Drawing Sheets

VISCOUS DRAG AND NON-LAMINAR FLOW COMPONENT OF UNDERWATER EROSION CONTROL SYSTEM

BACKGROUND OF THE INVENTION

1. Field of the Invention

This invention relates generally to an underwater erosion control system, and in particular, to an underwater erosion control system that disrupts laminar flow and increases viscous drag to cause particulates in fluids to precipitate.

2. Description of the Related Art

Devices used to prevent erosion of underwater surfaces, such as riverbeds, seabeds, and the like, and cause particulate deposition are known. Typical devices include buoyant frond elements or artificial seaweed anchored underwater in the area in which bed erosion (i.e., sea floor scour) is to be prevented. These devices operate by increasing viscous drag on the underwater current, which reduces the velocity of the current and of particulate transported by the current to a level where the particulate settles out of the current and is deposited in and around the erosion control system.

For example, U.S. Pat. No. 5,176,469 to Alsop discloses a structure comprising a continuous sequence of buoyant fronds arranged side by side to form a frond line. The frond line is folded back and forth to form frond sections. Each section has an aligned opening for receiving an anchor line for anchoring the array to the sea bed.

Another example of an underwater soil erosion prevention system is shown in U.S. Pat. No. 4,722,639 to Alsop. In this system, an open grid mat structure is used as a base to attach a number of randomly overlapping elongate buoyant frond elements. The open grid mat structure requires the grid lines to be at least nine inches (9") apart from one another in practice. Spacing the grid lines, and thus frond elements, so far apart from one another limits the viscous drag exerted and the amount of disruption of laminar flow on the current, and thus, the structure's erosion prevention capabilities. In addition, the open grid mat disclosed in the foregoing patent is not adapted to be efficiently manufactured and deployed.

An additional problem with prior underwater erosion prevention and control systems is the inability to provide a strong and durable yet sufficiently buoyant system to form a mound or berm of particulate removed from suspension. The system must be strong enough to provide sufficient resistance to the water current and durable enough to sustain resistance to the water current for an extended period of time. The system must also be sufficiently buoyant to rise to a level to be effective in dissipating enough energy in the moving fluid to cause particulate deposition and formation of a berm appropriate to arresting the erosion.

Therefore, a need exists for an easily manufactured and deployed device with sufficient durability and buoyancy to exert a maximum amount of laminar flow disruption and viscous drag on the water flow to maximize erosion control.

SUMMARY OF THE INVENTION

In accordance with the present invention, an underwater erosion control system is provided that disrupts laminar flow and exerts viscous drag on the moving fluid, slowing the velocity of the fluid and particulate carried thereby. This causes the particulate to settle and accumulate and prevents erosion in the vicinity of the underwater erosion control system.

In one aspect of the invention, an underwater erosion control system is provided that is made from a plurality of separate panels of material, each panel having a retaining portion adjoining one sheet having numerous parallel, vertical slits. The retaining portion is adapted to be anchored in contact with, or in close proximity to, the underwater surface where erosion is to be prevented. Preferably, when deployed underwater, the retaining portion is folded or bent along a center line and anchoring components are utilized on both sides of the center line. The slitted sheet of the anchored panel disrupts laminar flow and exerts viscous drag on the fluid. The panels are preferably spaced between one and six inches apart from one another thereby providing a high density of sheets affecting fluid velocity and laminar flow.

In another aspect of the invention, the separate panels of material comprising the underwater erosion control system have the retaining portion adjoining two sheets, each sheet having numerous parallel, vertical slits. When deployed underwater, the retaining portion is again folded or bent and the two sheets are oriented to be generally parallel to each other. Where the panels of material have two sheets, the panels are preferably spaced between one and six inches apart.

The slits in each sheet are generally perpendicular to the retaining portion, and terminate at the top edge of each sheet. These slits define strips and the length and width of the strips defines the degree of laminar flow disruption exerted by the panel. The panels of material are buoyant, i.e., have a specific gravity of less than 1.0 g/cm$^3$. Preferably the panels of material have a specific gravity less than 0.5 g/cm$^3$.

The retaining portion of each panel may contain one or more openings for receiving components to anchor and secure the panels to the underwater erosion control system and the underwater surface. The openings may be aligned with each other and aligned with the openings on successive panels. The openings are sized to receive a rigid component for anchoring the panel to an underwater surface, e.g., the seabed or riverbed. Alternatively, the openings are sized to receive a flexible synthetic strap or rope for anchoring the panel to an underwater surface. The anchoring component can be attached to anchors directly or to straps that are attached to anchors.

The panels of material used to disrupt laminar flow in the fluid are durable and buoyant. The material is a laminate having a backing for durability and strength. Preferably, the backing is a woven polyethylene that is coated with a polymer, such as polyethylene, to reduce abrasion and fraying. Alternatively, the backing may be a woven polypropylene that is coated with a polymer to reduce abrasion and fraying. The backing is stabilized against ultraviolet radiation. For buoyancy, the backing is laminated to a closed cell foam. The closed cell foam is preferably a polyethylene foam. The material preferably has a specific gravity of less than 0.5 g/cm$^3$ and a tensile strength in excess of 100 pounds in both the warp and weft, as measured by American Society for Testing and Materials (ASTM) D751 Method A for woven backing materials.

DETAILED DESCRIPTION OF THE PREFERRED EMBODIMENTS

Figure 1:
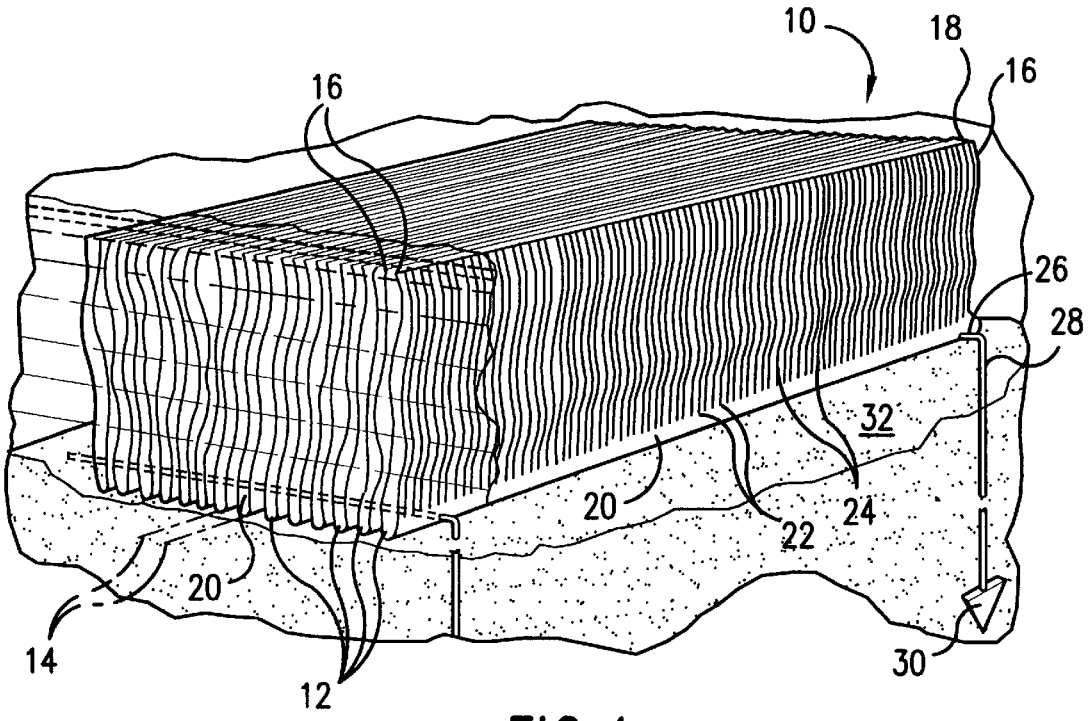
FIG. 1 is a perspective view showing a portion of an underwater erosion control system in accordance with the present invention.

Turning to the drawings, FIG. 1 shows a perspective view of a portion of an underwater erosion control system 10 deployed in an underwater environment in accordance with the present invention. The underwater erosion control system 10 is composed of an array of panels of material 12, each panel of material 12 having a retaining portion 20 intermediate two sheets 16. Preferably, retaining portion 20 and sheets 16 are formed from one contiguous piece of material. Alternatively, sheets 16 may be separate and distinct from retaining portion 20 and each other and may be attached, such as by stitching, gluing, clipping or clamping, to retaining portion 20. Each panel of material 12 is bent or folded along a center line 14 of retaining portion 20. Each sheet 16 has a top edge 18 that is free and unattached. Slits 22 define strips 24, which extend from top edge 18 down to retaining portion 20. Retaining portion 20 of each panel of material 12 has openings 26 that are aligned to receive anchor component 28, which is used to secure underwater erosion control system 10 to seabed 32.

Figure 2:
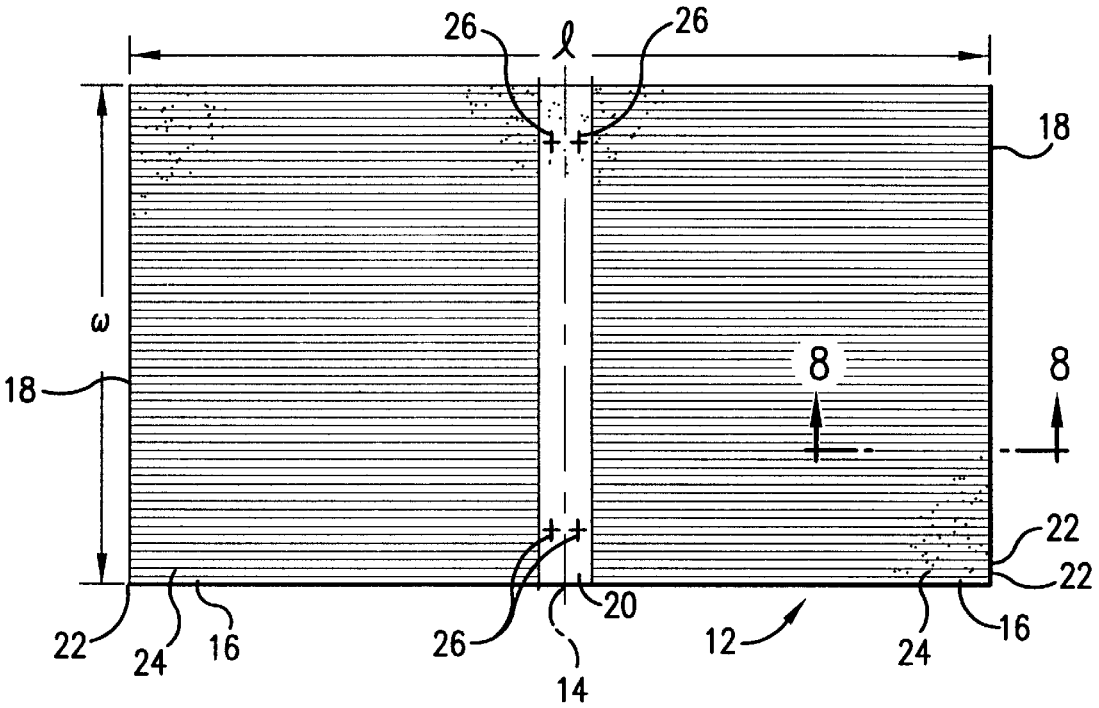
FIG. 2 is a top view of a panel of material used in the underwater erosion control system shown in FIG. 1, wherein the panel is lying flat.
Figure 3:
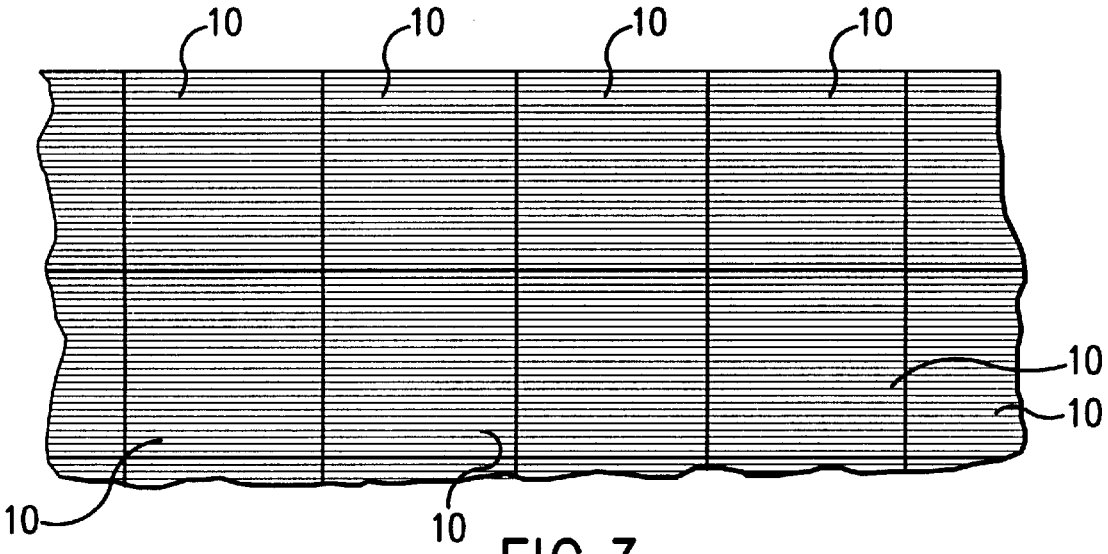
FIG. 3 is a top view of an arrangement of multiple underwater erosion control systems in accordance with the present invention.

FIG. 2 shows a top view of panel of material 12 lying flat, i.e., lying in its natural state when not in water. Panel of material 12 can be of any length (l) and width (w) desired to create an underwater erosion control system of any height and width. The length of system 10 is defined by the number and spacing of panels used. Considerations concerning materials availability, manufacturing and deployment of system 10 may affect the desired dimensions of the underwater erosion control system. A preferable size of system 10 for purposes of manufacturing and deployment is about 60 inches by 90 inches by about 54 inches high, with each panel of material 12 spaced between 1 to 6 inches apart from each successive panel of material 12. As shown in FIG. 3, multiple systems 10 may be placed side-by-side to extend the width of the area protected from underwater erosion. Additionally, multiple systems 10 may be placed in front of, or behind, other units to further extend the area protected from underwater erosion.

As best seen in FIG. 2, each sheet 16 contains slits 22, which define strips 24, with slits 22 beginning at the retaining portion 20 and terminating at top edge 18. Retaining portion 20 is sized to be sufficiently wide to reduce the susceptibility of slits 22 extending through to openings 26. Preferably, retaining portion 20 is 6 inches wide with openings 26 spaced an equal distance from center line 14 and sheets 16.

Figure 4:
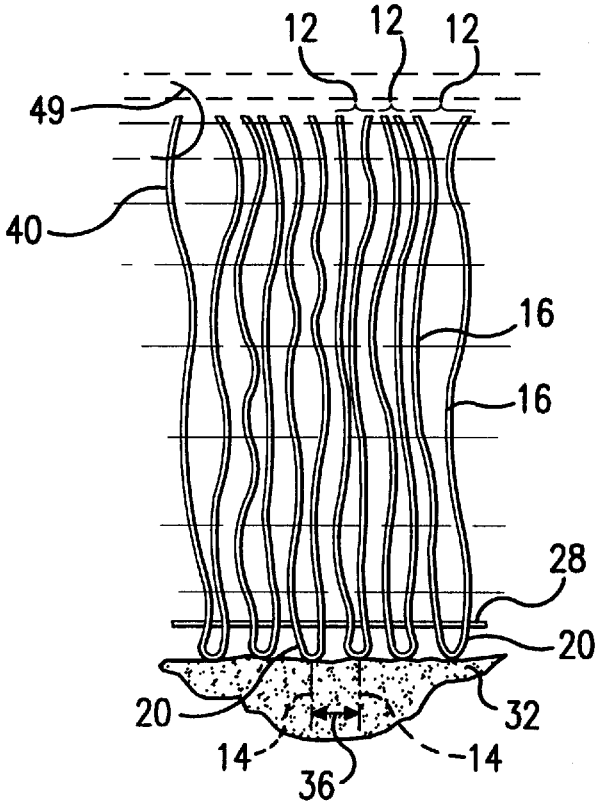
FIG. 4 is a side view of a portion of the underwater erosion control system shown in FIG. 1.

For securing system 10 to underwater surface 32, retaining portion 20 of each panel 12 contains openings 26 on either side of center line 14. Openings 26 are aligned with respective openings 26 on either side of center line 14, so that when folded and deployed in system 10, anchor component 28 is inserted through openings 26 as best seen in FIG. 4. Anchor component 28 is directly attached to an anchor 30, as shown in FIG. 1.

Openings 26 in FIG. 2 are shown as crosses that are burned into retaining portion 20 of panel of material 12. Openings 26 may be formed in any suitable manner for receiving an anchor component. Suitable anchor components and frame arrangements are disclosed in U.S. patent application Ser. No. 08/665,257 entitled "Frame and Method for Installing Viscous Drag and Non-Laminar Flow Components of an Underwater Erosion Control System," filed concurrently herewith and assigned to the same assignee as the present application, the disclosure of which is hereby incorporated by reference.

As illustrated in FIG. 4, center line 14 of retaining portion 20 of successive panels of material 12 are spaced some distance 36 apart along anchor component 28, such distance 36 representing the desired spacing or separation and preferably being between 1 to 6 inches. The optimal spacing 36 is determined by the velocity of the fluid and the size and specific gravity of the particulate suspended in the fluid. Use of a 1 to 6 inch spacing along anchor component 28 places each sheet 16 close to each successive sheet 16, creating a high density of sheets 16. The high density of sheets 16 increases viscous drag and disrupts laminar flow, thereby causing more particulate to settle and deposit, and reducing riverbed, seabed, or shoreline erosion.

Figure 5:
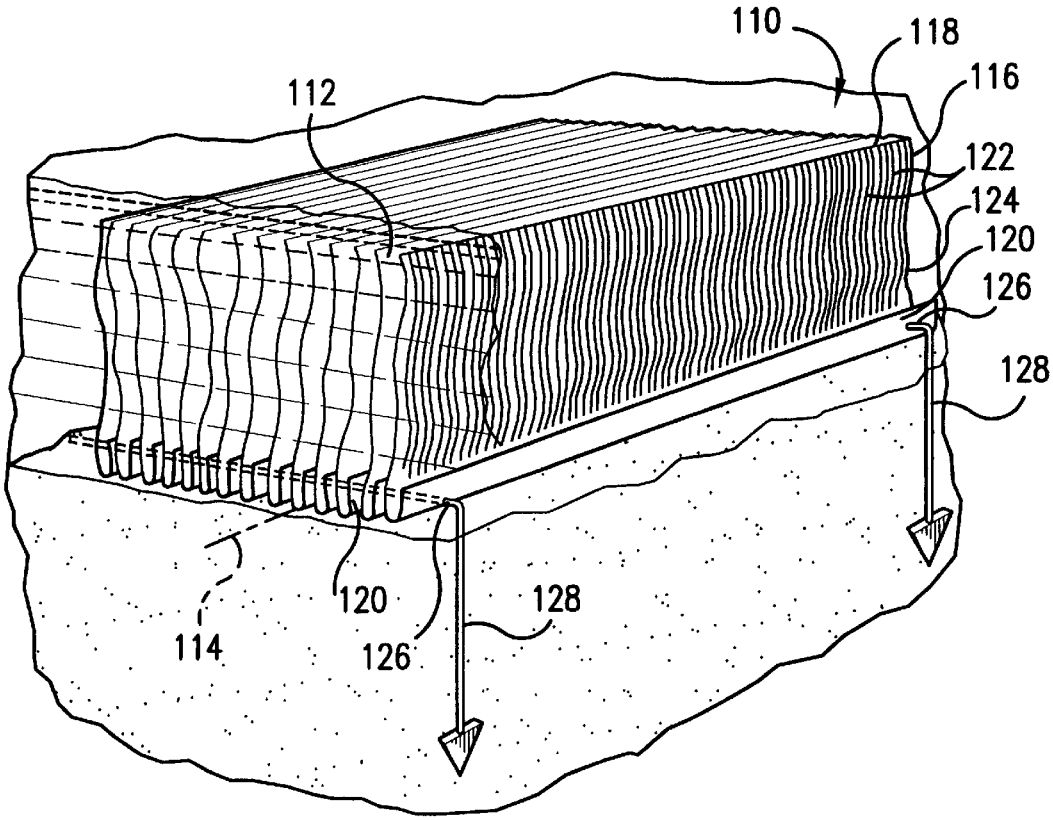
FIG. 5 is a perspective view of an alternative embodiment of an underwater erosion control system in accordance with the present invention.
Figure 6:
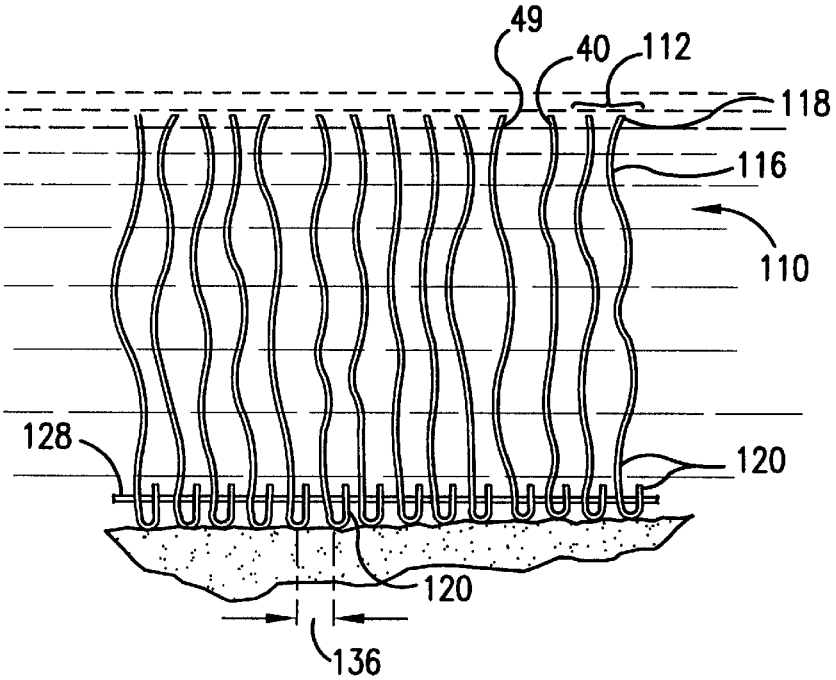
FIG. 6 is a side view of a portion of the underwater erosion control system shown in FIG. 5.

FIG. 5 is a perspective view of an alternate embodiment of an underwater erosion control system 110 in accordance with the present invention. FIG. 6 is a side view of a portion of system 110. System 110 is composed of an array of panels of material 112 having a retaining portion 120 adjoining a single sheet 116. Sheet 116 has slits 122 extending from top edge 118 to retaining portion 120 to define strips 124. Panel of material 112 is folded along a center line 114 of retaining portion 120 with openings 126 on either side of retaining portion 120 receiving anchor component 128. Center lines 114 of successive panels of material 112 are spaced a distance 136 apart, such distance being preferably 1 to 6 inches.

Figure 7:
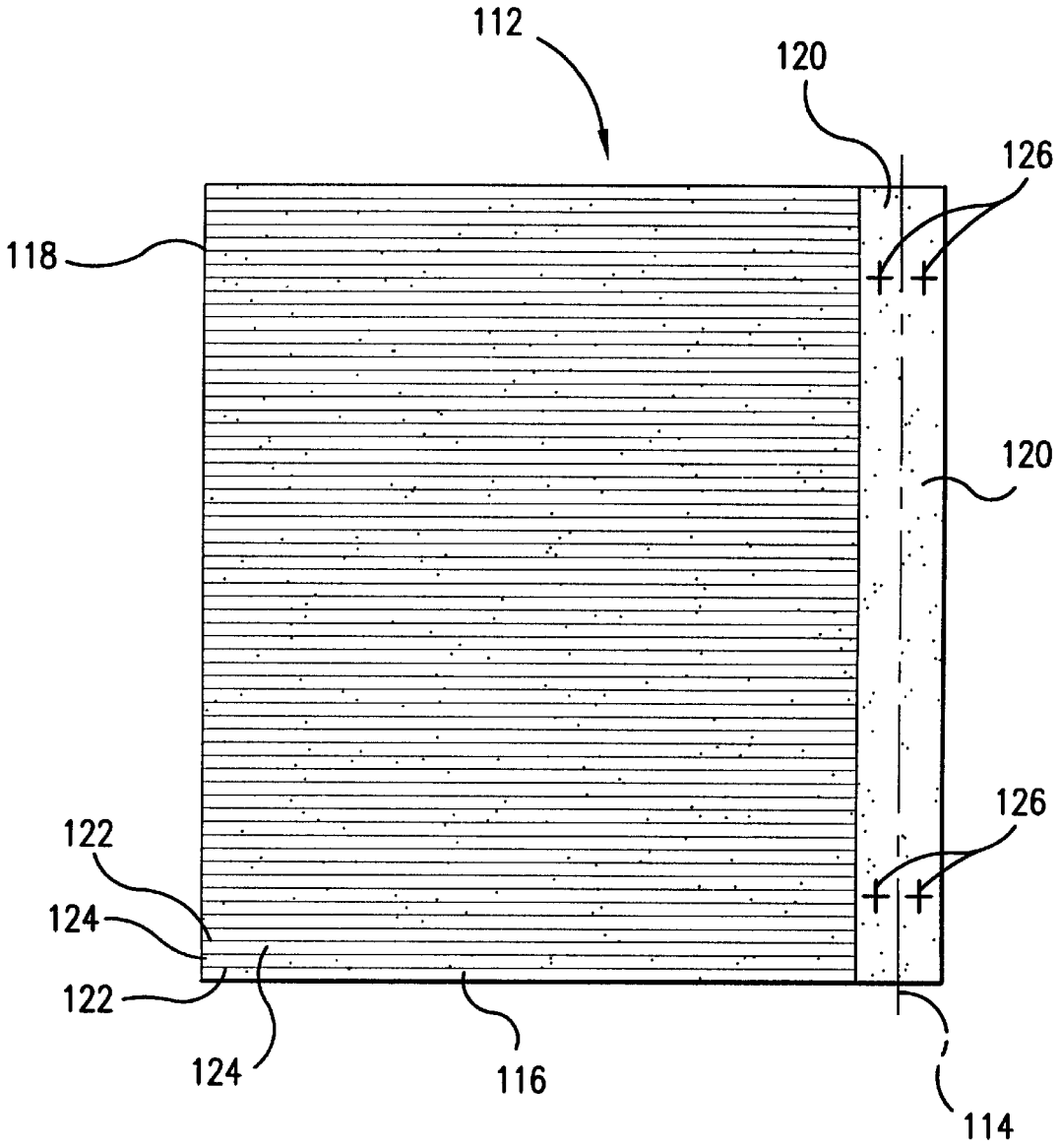
FIG. 7 is a top view of a panel of material used in the underwater erosion control system shown in FIG. 5 wherein the panel is lying flat.

FIG. 7 is a top view of panel of material 112 shown lying flat. Sheet 116 contains slits 122 preferably spaced about 2.54 cm (1 inch) apart. The spacing between slits may be adjusted as a function of the size and specific gravity of the particulate in suspension and the velocity of the fluid. Slits 122 define strips 124, with slits 122 beginning at retaining portion 120 and terminating at top edge 118. Preferably, retaining portion 120 is 6 inches wide with openings 126 spaced an equal distance from centerline 114.

Figure 8:
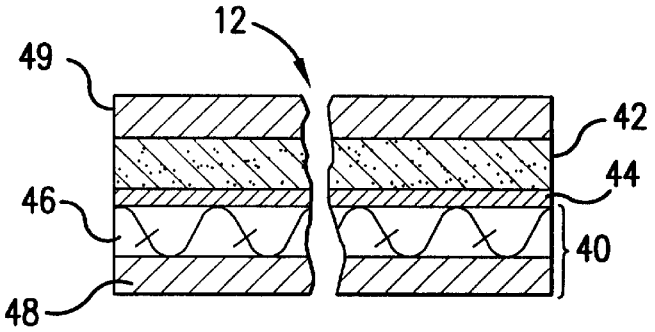
FIG. 8 is a cross sectional view of the panel of material shown in FIG. 2 taken along line 8-8.

FIG. 8 shows a cross sectional view of panel of material 12 highlighting the components of the material. Panel of material 112 is preferably of the same composition. A distinct advantage of the present invention over prior erosion control systems lies in the durability, strength and buoyancy of panel of material 12.

Panel of material 12 is composed primarily of a backing 40 and a layer of foam 42. Backing 40 and foam 42 are combined by lamination 44, which provides a consistent bond between backing 40 and foam 42. Backing 40 is preferably formed from a woven polymer 46 with one coat 48 of a polymer on the side that is not laminated. The coating 48 preferably contains commonly known ultraviolet stabilizing agents to protect backing 40. Alternatively, woven polymer 46 may be coated on both sides with a polymer prior to lamination. Preferably, backing 40 is formed from a woven polyethylene and coated on one side with polyethylene and stabilized against ultraviolet radiation. Alternatively, backing 40 is formed from a woven polypropylene coated on one side with polypropylene and stabilized against ultraviolet radiation. The preferred backing 40 has a tensile strength in excess of 100 pounds in warp and weft as measured by ASTM D751 Method A. More preferably, backing 40 has a tensile strength of 200 pounds in warp and weft as measured by ASTM D751 Method A. The strength of backing 40 should be maintained after lamination to foam 42. Preferably foam 42 is 100% closed cell polyethylene having a density in excess of 1 pound per cubic foot, and more preferably, having a density between 1.2 to 1.4 pounds per cubic foot. An additional coating 49 of a polymer, such as polyethylene, may be added to the side of foam 42 that is not laminated. Preferably, coating 49 exceeds 1.0 mils in thickness. The preferred thickness for panel of material 12 is 0.08 to 0.12 inches. A preferred material for making panel 12 is available from American Sales & Distribution Services, Inc., Dolton, Ga. sold under the trade name AMERIBOND 803S.

In the embodiment shown in FIG. 4, when folded for deployment, coating 49 is preferably folded to form an interior side of sheet 16, while backing 40 forms the exterior side of sheet 16. For the embodiment shown in FIG. 6, coating 49 is adjacent backing 40 of adjacent sheets 16.

As may be appreciated from the nature of panel of material 12, when out of water prior to deployment, system 10 can be folded substantially flat by laying successive sheets against one another. However, when underwater, sheets 16 float upward due to their buoyant state. Because sheets 16 may float upward when underwater before an installer is ready for sheets 16 to do so, a restraining device such as a net (not shown) can be placed over the sheets to restrain them until after system 10 has been anchored at the desired location on the seabed 32. Generally, a diver or group of divers transport restrained system 10 to the desired location along the seabed or riverbed. Anchors 30 are then used to secure system 10 in place. The retaining portion 20 of panels of material 12 are preferably placed as close as possible to and in contact with the seabed.

Figure 9:
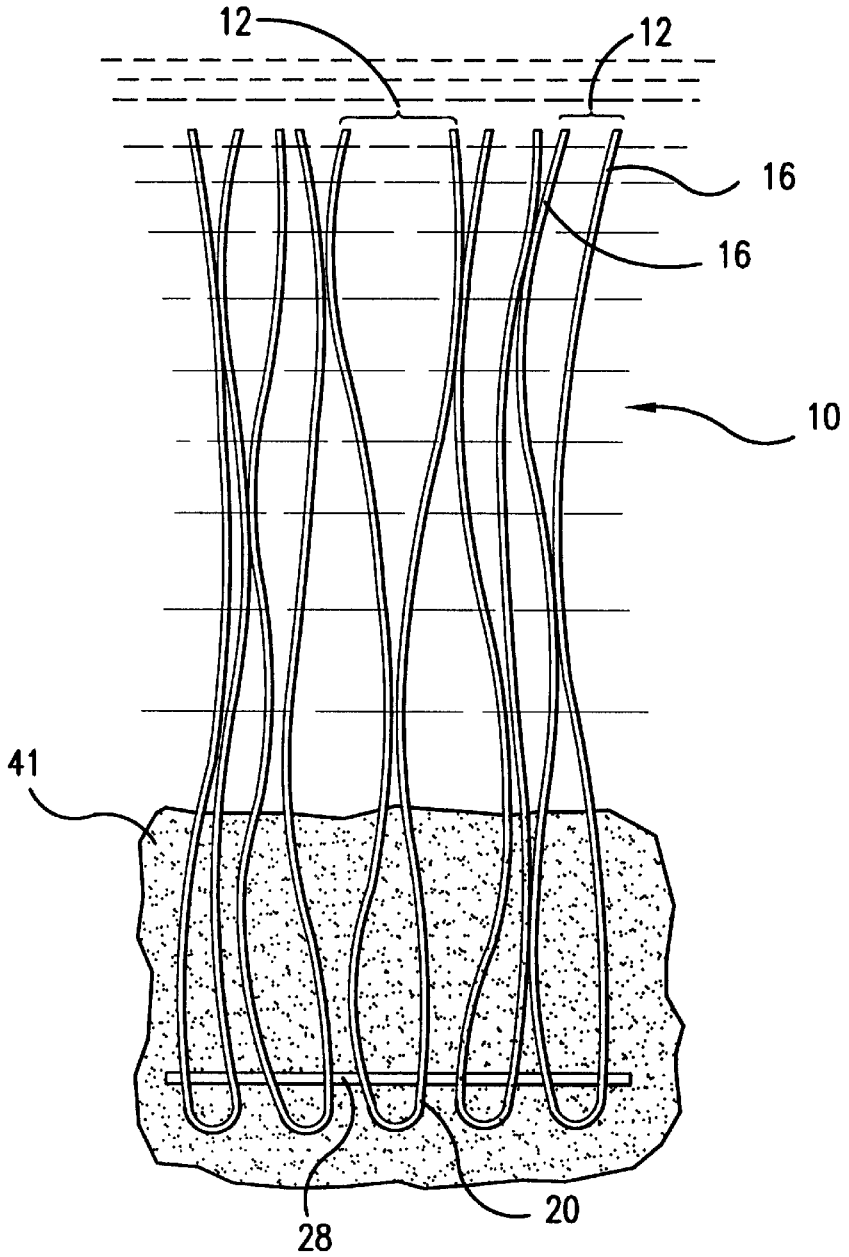
FIG. 9 is a side view of a portion of the underwater erosion control system shown in FIG. 1, wherein a berm has begun to form.

Once anchored in place the restraining device may be removed. Most preferably the restraining device will have floatable buoys to cause the restraining device to float to the surface for retrieval. The panels of material 12 are then free to float. The densely packed sheets 16 with strips 24 exert a viscous drag on the water current and disrupt laminar flow, causing particulates carried by the water current to precipitate out and be deposited in the vicinity of system 10. Over a period of time the configuration of system 10 advantageously causes a berm or mound 41 to form in the vicinity of system 10, as shown in FIG. 9.

While the present invention has been described with respect to certain preferred embodiments, it is to be understood that the invention is capable of numerous changes, rearrangements and modifications as fall within the spirit and scope of the appended claims.

What is claimed is:

1. An underwater erosion control system comprising:

a plurality of panels of material, each of said panels of material being detached from the material of the other said panels;

each panel of material having a retaining portion and a first sheet adjoining said retaining portion, said retaining portion being adapted to be secured to an underwater surface, said panel having a backing layer and a buoyant layer, said buoyant layer being laminated to said backing layer; and said sheet having a plurality of slits extending from a top edge of said sheet to said retaining portion to define a plurality of strips; and wherein said buoyant layer has a configuration substantially identical to that of said backing layer, such that said buoyant layer extends along the entire lengths of said strips, and wherein said buoyant layer extends from said top edge of said sheet; and wherein said retaining portion includes a portion of said backing layer and a portion of said buoyant layer; and wherein said buoyant layer extends as one continuous piece from said top edge of said sheet and through said retaining portion.

2. The system of claim 1 wherein said buoyant layer includes foam, said buoyant layer being bonded to said backing layer by a lamination layer.

3. The system of claim 2 wherein when said system is deployed underwater, said retaining portion is folded along a center line.

4. The system of claim 2, each panel of material having a second sheet adjoining said retaining portion, and wherein said retaining portion is oriented such that said first and second sheets are generally parallel to each other.

5. The system of claim 4 wherein said panel of material has a specific gravity of less than 1.0 grams per cubic centimeter, and wherein the specific gravity of said retaining portion at said fold line is essentially the same as the specific gravity of said strips.

6. The system of claim 1 wherein said panel of material is formed of woven material having a strength of at least 100 pounds in warp and weft as measured by ASTM D751 Method A.

7. The system of claim 4 wherein each said retaining portion contains openings, and wherein said system further comprises an anchor for securing said retaining portion to an underwater surface, said anchor being slidably located in said openings.

8. The system of claim 4 wherein said plurality of slits on each sheet are at least 0.25 inches apart, and wherein said slits are formed after said buoyant layer is laminated to said backing layer.

9. The system of claim 2 wherein said backing layer comprises a woven polyethylene coated on one side with polyethylene.

10. The system of claim 2 wherein said backing layer comprises a woven polypropylene coated on one side with a polymer.

11. The system of claim 2 wherein said foam comprises a 100% closed cell polyethylene.

12. The system of claim 2 wherein said panel of material has a specific gravity of less than 0.50 grams per cubic centimeter.

13. The system of claim 11 wherein said foam has a density greater than one pound per cubic foot.

14. The system of claim 4 wherein said plurality of panels of material are spaced with center lines of said retaining portions of successive panels of material between one to six inches apart.

15. The system of claim 14 wherein said plurality of panels of material are configured such that said sheets of said plurality of panels are generally parallel to each other when said system is deployed under water, and wherein said system further comprises an anchor for securing each of said sheets to an underwater surface.

16. The system of claim 1 wherein each of said plurality of strips is up to 3 inches wide and up to 110 inches in length.

* * * * *